US008393041B2

(12) United States Patent
Cieri

(10) Patent No.: US 8,393,041 B2
(45) **Date of Patent: *Mar. 12, 2013**

(54) GOLF CLUB CLEANING DEVICE

(75) Inventor: Christopher W. Cieri, Waxhaw, NC (US)

(73) Assignee: Exsite Golf, Inc., Waxhaw, NC (US)

( * ) Notice: Subject to any disclaimer, the term of this patent is extended or adjusted under 35 U.S.C. 154(b) by 152 days.

This patent is subject to a terminal disclaimer.

(21) Appl. No.: 12/971,290

(22) Filed: Dec. 17, 2010

(65) Prior Publication Data

US 2011/0083293 A1 Apr. 14, 2011

Related U.S. Application Data

(63) Continuation-in-part of application No. 12/119,764, filed on May 13, 2008, now Pat. No. 7,904,986.

(51) Int. Cl.
*A63B 57/00* (2006.01)

(52) U.S. Cl. ..... 15/105; 15/106; 15/114; 15/118; 15/160; 15/210.1

(58) Field of Classification Search ..... 15/21.1, 15/21.2, 104.92, 105, 106, 112, 114, 118, 15/160, 161, 210.1, 244.1; 473/405; D21/789, D21/793–796

See application file for complete search history.

(56) References Cited

U.S. PATENT DOCUMENTS

| | | | | | |
|---|---|---|---|---|---|
| 28,614 | A | * | 6/1860 | Staman | 15/161 |
| 3,002,211 | A | * | 10/1961 | Mathes | 15/112 |
| 3,224,029 | A | * | 12/1965 | Domingos | 15/104.92 |
| 3,748,676 | A | * | 7/1973 | Warren et al. | 15/21.2 |
| 3,950,810 | A | | 4/1976 | Harkness | |
| 4,069,536 | A | * | 1/1978 | Hartz et al. | 15/104.92 |
| 4,384,384 | A | | 5/1983 | Trojohn | |
| 4,464,072 | A | | 8/1984 | Norwell | |
| 4,472,581 | A | | 9/1984 | Dodson | |
| 4,541,138 | A | | 9/1985 | Varrial | |
| 4,734,953 | A | | 4/1988 | Dodson | |
| 4,821,358 | A | | 4/1989 | Wyckoff et al. | |
| 4,872,232 | A | | 10/1989 | Stiasny | |
| 4,944,063 | A | | 7/1990 | Jordan | |
| 4,951,339 | A | | 8/1990 | Braun | |

(Continued)

FOREIGN PATENT DOCUMENTS

| | | | |
|---|---|---|---|
| GB | 2268413 | * | 1/1994 |
| GB | 2352617 | * | 2/2001 |

OTHER PUBLICATIONS

Excite Golf, Inc., International Search Report and Written Opinion of the International Searching Authority; PCT/US2009/43763: Filed May 13, 2009.

*Primary Examiner* — Mark Spisich
(74) *Attorney, Agent, or Firm* — Clements Bernard PLLC; Christopher L. Bernard; Lawrence A. Baratta, Jr.

(57) ABSTRACT

In various exemplary embodiments, the present invention provides a portable golf club cleaning device, for cleaning the head of a golf club, including: a cleaning portion with one or more outwardly-facing exterior cleaning surfaces disposed about a central axis; a handle portion disposed at a top end of the cleaning portion including a gripping member whereby the portable golf club cleaning device is selectively gripped; and an elongated spike portion disposed at a bottom end of the cleaning portion substantially opposite the top end of the cleaning portion, the elongated spike portion extending from the cleaning portion and wherein central axes of the handle portion and the spike portion are vertically aligned, the elongated spike portion providing a support means for supporting the portable golf club cleaning device in an upright manner when depressed into the ground.

11 Claims, 10 Drawing Sheets

U.S. PATENT DOCUMENTS

| | | | | |
|---|---|---|---|---|
| 4,958,396 | A | | 9/1990 | Butler et al. |
| 4,965,906 | A | | 10/1990 | Mauro |
| 5,155,883 | A | | 10/1992 | Legault |
| 5,203,048 | A | | 4/1993 | Bynum |
| D367,907 | S | * | 3/1996 | Sandstrom et al. ..... D21/794 |
| 5,533,225 | A | | 7/1996 | Ellis |
| 5,560,066 | A | | 10/1996 | McDivitt |
| 5,664,277 | A | * | 9/1997 | Matlock ..... 15/160 |
| 5,732,435 | A | | 3/1998 | Williams et al. |
| 5,742,965 | A | | 4/1998 | Leask |
| 5,787,539 | A | | 8/1998 | Nussbaum |
| 5,819,355 | A | | 10/1998 | Wu |
| 5,878,460 | A | | 3/1999 | Bruce |
| 5,908,254 | A | | 6/1999 | Anderson |
| 5,940,918 | A | | 8/1999 | Binette |
| 6,021,537 | A | | 2/2000 | Smith |
| 6,216,305 | B1 | | 4/2001 | Joh |
| 6,240,592 | B1 | | 6/2001 | Li |
| 6,938,296 | B1 | | 9/2005 | Scheuermann |
| 2007/0169294 | A1 | | 7/2007 | Cieri |

* cited by examiner

GOLF CLUB CLEANING DEVICE

CROSS-REFERENCE TO RELATED APPLICATION(S)

The present patent application/patent is a continuation-in-part of U.S. patent application Ser. No. 12/119,764, entitled "GOLF CLUB CLEANING DEVICE," and filed on May 13, 2008, now U.S. Pat. No. 7,904,986 the contents of which are incorporated in-full by reference herein.

FIELD OF THE INVENTION

The present invention relates generally to the sporting goods and golf equipment fields. More specifically, the present invention relates to a golf club cleaning device that includes a cleaning portion including one or more cleaning surfaces/materials; a flag portion disposed at a first end of the cleaning portion; and a spike portion disposed at a second end of the cleaning portion substantially opposite the first end of the cleaning portion. By grasping the flag portion, the spike portion is selectively disposed in the ground at a predetermined location associated with a golf course, practice range, or the like, thereby allowing a player to clean his/her golf club by selectively running the front face and/or rear face of the golf club horizontally and/or vertically across the one or more cleaning surfaces/materials of the cleaning portion. Advantageously, the flag portion optionally incorporates an advertising logo and/or informational text.

BACKGROUND OF THE INVENTION

A number of golf club cleaning devices are known to those of ordinary skill in the art. These include the golf club cleaning devices disclosed in U.S. Pat. Nos. 6,938,296; 6,216,305; 6,021,537; 5,940,918; 5,908,254; 5,878,460; 5,819,355; 5,787,539; 5,742,965; 5,732,435; 5,560,066; 5,533,225; 5,203,048; 5,155,883; 4,965,906; 4,958,396; 4,951,339; 4,944,063; 4,872,232; 4,821,358; 4,734,953; 4,541,138; 4,472,581; 4,464,072; 4,384,384; and 3,950,810, among others.

U.S. Pat. No. 6,938,296, issued to Scheuermann on Sep. 6, 2005, discloses a portable golf club washer which has a first golf iron brush that has a bristle side. A second golf iron brush has a bristle side. The second golf iron brush and the first golf iron brush are connected to end plates so that the second golf iron brush bristle side faces the first golf iron brush bristle side. A golf wood brush has a bristle side. The golf wood brush is connected to the second golf iron brush. The golf wood brush bristle side faces away from the second golf iron brush bristle side. A handle is connected to the first golf iron brush.

U.S. Pat. No. 6,216,305, issued to Joh on Aug. 17, 2001, discloses a washing apparatus for golfers, which comprises: a flexible container for containing washing liquid and for receiving objects to be washed therein, a handle connected to the container for manipulating same; and a support mechanism for suspending the container and the handle from a golf bag and for restricting movement of the container relative to the golf bag when suspended therefrom. The container includes an access opening defined therein through which objects such as golf club heads may be inserted, a closure for selectively sealing the opening, at least one flap extending away from the closure, a brush disposed within said container for scrubbing against objects inserted into the container during a washing operation, and (optionally) a baffle for baffling movement of the washing liquid toward the opening after the liquid is placed in the container. The handle is operatively connected to the container flap. The support mechanism includes a clip member for suspending the handle from a rim of a golf bag and which normally urges the container toward the golf bag when suspended therefrom to restrict movement of the container, while the support mechanism may optionally include a pouch in which said container is disposed and which operatively cooperates with the clip member to restrict movement of the container. When the pouch is used, the handle is also connected to said pouch. The several components of the washing apparatus are preferably separable from each other for cleaning, storage, selective replacement, etc.

U.S. Pat. No. 6,021,537, issued to Smith on Feb. 8, 2000, discloses a cleaning apparatus for golf balls and golf club heads which has a base portion that houses a motor, the base portion being adapter to removably engage a receiver housing containing a rotatably mounted brush. The motor removably and operably engages the brush through a plurality of gears that are brought into operable engagement when the receiver housing removably engages the base portion. The receiver housing is then filled with cleaning fluid and the user can wash his clubs in the cleaning fluid by holding the clubs against the brush as the motor causes the brush to rotate. A golf ball cassette filled with dirty golf balls can also be inserted into the receiver housing. The rotation of the brush drives the dirty golf balls in a circular pattern, causing them to be cleaned by top and bottom ball wash brushes of the golf ball cleaning cassette.

U.S. Pat. No. 5,940,918, issued to Binette on Aug. 24, 1999, discloses, in an apparatus for cleaning a golf club head, a brush having a plurality of bristles that is rotatably mounted on a housing. Within the housing are two lateral support surfaces spaced apart from each other and defining a channel therebetween for receiving and retaining the golf club head. The bristles of the brush define an arcuate path of movement extending along at least a portion of the channel, and thus the bristles engage the face of the club received within the channel. As the brush rotates it removes dirt and other debris from the face of the club. Preferably, there is also a brush-engaging surface, such as a ledge, which projects into the arcuate path of movement of the bristles. The brush-engaging surface engages the bristles upon rotation of the brush, thereby dislodging dirt and other debris from the bristles.

U.S. Pat. No. 5,908,254, issued to Anderson on Jun. 1, 1999, discloses a club mate apparatus including a container that has a bottom wall, a top edge and a peripheral wall. The top edge has an eyelet integral therewith. A top wall has an opening therethrough. A pair of resilient clamps is attached to the top wall of the container. A brush member is included and has an elongated handle and a head portion with a bristle arrangement. A ridge disk member is integral the handle and spaced from a handle end. Finally, a ring seal is positioned around the disk member.

U.S. Pat. No. 5,878,460, issued to Bruce on Mar. 9, 1999, discloses a golf iron brush designed to clean all golf club irons of loose and embedded debris is provided. The device comprises a housing with top and bottom openings and a front slot extending from top to bottom. The housing has interior opposing brushes which define a central gap through which a golf club iron head is swiped. The housing allows the club head to be passed through, in horizontal alignment of the club shaft, in the direction of the control grooves on the face of the club. This allows the brushes to clean within the grooves for a thorough cleaning U.S. Pat. No. 5,819,355, issued to Wu on Oct. 13, 1998, discloses a club head brush having a first bristle holder and a second bristle holder at one end of the body thereof, the first bristle holder and the second bristle holder holding bundles of bristles of different softness for cleaning golf club heads, and a pick coupled to a sliding switch at an opposite end of the body and used for removing dirt from scoring lines and grooves on golf club heads, the pick being moved in and out of a through hole at the rear end of the club head brush when the sliding switch is moved along a longitudinal sliding slot on the body.

U.S. Pat. No. 5,787,539, issued to Nussbaum on Aug. 4, 1998, discloses a hand held golf club cleaner that utilizes a common plunger to apply power to a motor that rotates a cleaning brush, and to pump a cleaning fluid from a reservoir inside the golf club cleaner onto the golf club head. A set of gears reduces the speed of brush rotation from the speed of the motor to provide greater brush rotational torque.

U.S. Pat. No. 5,742,965, issued to Leask on Apr. 28, 1998, discloses a coin-operated golf club cleaner cabinet. Behind an access port in the front of the cabinet is mounted a structural housing comprising a rectangular box frame for supporting two pairs of cup-type brushes, positioned facing and in-line with a gap between them for receiving a golf club head. The first pair of brushes has aggressive bristles and forms a narrow gap between the facing brushes for cleaning irons, the second pair having softer bristles and a wider gap for cleaning woods. The housing has two small front curtained ports for permitting club access to the appropriate brush gap. Three in-line shafts provide two pairs of facing shaft ends upon which are mounted the two pairs of brushes. A line shaft and electric drive provide speed reduction to the three in-line shafts. For convenient access of the brushes for adjustment and maintenance purposes, the housing can be pivoted within the cabinet to present its substantially open base to the cabinet's access port. Cleaning fluids are circulated from a tank located beneath the housing and up to the brushes. The tank is mounted on rails for ready access and removal outside the side of the cabinet. A coin-operated duration time provides convenient actuation of the brush drive motor and pump.

U.S. Pat. No. 5,732,435, issued to Williams et al. on Mar. 31, 1998, discloses a device for cleaning golf-club heads comprises a receptacle for containing cleaning solution open at its upper end for receiving a golf-club head to be cleaned, and at least one brush mounted within the receptacle for engagement with the club head. An extension of a base portion projects outwardly of the device a sufficient distance to receive at least a portion of a user's foot thereon to stabilize the cleaning device when supported in an upright position on a horizontal surface. A handle may be formed on the base portion extension for conveniently lifting and transporting or for storing and draining the cleaning device. A cap may be provided for closing the upper end of the receptacle to prevent loss of cleaning liquid during transportation and handling of the cleaning device.

U.S. Pat. No. 5,560,066, issued to McDivitt on Oct. 1, 1996, discloses a portable golf club cleaner has a rotatable brush and a recirculating pump powered by a power supply, and an activation switch such that whenever a club face comes in contact with the rotatable brush, a motor rotates the brush while the recirculating pump provides a cleansing spray of cleaning solution to the club face. Furthermore, the portable golf club cleaner is constructed such that the cleaning solution is recirculated through a filter and into a reservoir so as to effectively clean golf club faces for an entire round of golf. The portable golf club cleaner also has a detachable front cover so that the club face of larger clubs, such as woods and drivers can also be cleaned without difficulty.

U.S. Pat. No. 5,533,225, issued to Ellis on Jul. 9, 1996, discloses an improved heavy-duty soft plastic golf club washer having the design of an old fashioned bath tub with a protected opening at the sloped front end large enough to accommodate all sizes of golf club heads. Stabilized inside tub are three identical soft plastic brushes each with two slotted openings in their base to allow passage of sediment into sump. The brushes are stabilized inside tub by means of brush locks middle, and brush locks rear, and also by the bottom horizontal brush base. A removable lid with front opening and an open groove to allow movement of golf club shafts. Tub has two rear support flanges designed to fit a standard 4" times 4" post, over which the squared opening at rear of lid also fits to cover tub. A rectangular lock plate fits over rear of lid and locks lid to post with two bolts and two spring type cotter pins. The lid locks with tub by means of interlocking lips and interlocking lips on tub. Each side of tub has a drain opening hole to maintain correct water level.

U.S. Pat. No. 5,203,048, issued to Bynum on Apr. 20, 1996, discloses a golf club head brush for cleaning a golf club head comprises a relatively flat, generally-rectangular, handle having opposite brush and non-brush sides bounded by shaft, head, thumb and finger edges, with brush bristles mounted on the brush side directed outwardly away from the handle. The handle is constructed of a resilient material so as to be bendable. The brush and non-brush sides have the generally-rectangular shape, but include a thumb protrusion at the thumb edge with bristles thereon. The shaft edge includes an outwardly flaring shaft slot therein for receiving a shaft when the bristles are used to clean a golf club head.

U.S. Pat. No. 5,155,883, issued to Legault on Oct. 20, 1992, discloses a device for selectively cleaning the head of a golf club or for cleaning the surface of a golf ball, including a housing having a cleaning chamber formed therein, a pair of brush members being mounted in the housing for counterrotation, each of the brush members being mounted on separate shafts that are disposed in the housing in spaced parallel relation so that the bristles of the brush members are disposed in overlapping relation with respect to each other, the head of a golf club being insertable into the chamber for location of the face of the club in engaging relation with the bristles of the brush members, the chamber having a liquid contained therein and the counterrotating movement of the brush members creating movement of the liquid in the chamber between the brush members, wherein the movement of the liquid cooperates with the movement of the brush members to effectively clean the club head as disposed therebetween, and a top member having a ball receiving tube joined thereto, the top member being removably mounted on the housing and receiving a ball therein for engagement with the bristles of the brush members, and means for rotating the brush members to selectively clean either the face of the club in engagement therewith or the surface of the ball as disposed in engaging relation therewith.

U.S. Pat. No. 4,965,906, issued to Mauro on Oct. 30, 1990, discloses a combination golf ball and golf club head cleaner that is mounted to the fender of a golf cart or to a conveniently located post. The device includes a water-tight housing member having a first brush-lined cylindrical chamber for cleaning a golf ball and a second brush-lined parallelepiped chamber for cleaning a club head. A ball holder that retains a ball while allowing it to rotate when scrubbed is mounted for reciprocation along its vertical axis in the ball cleaning chamber. Brushes lining the first chamber scrub the ball and rotate it as the holder is reciprocated. The chambers are in fluid communication with one another so that removal of a single plug drains both chambers.

U.S. Pat. No. 4,958,396, issued to Butler et al. on Sep. 25, 1990, discloses a golf ball and golf club cleaning device uniquely suited to the task of cleaning golf balls and golf clubs with wood or metal heads of either left-handed or right-handed configuration. This device employs a rotating segment brush assembly, lifted by cam action, to work about its x and y axes simultaneously; and further, this device provides a spring-biased club head receiver, assuring positive club head placement and brush contact. A ball carrier slide extending vertically from the housing lid provides proper ball insertion, cleaning and removal. Additionally, size and configuration of this device are compatible to either stationary mounting, or mounting to a motorized vehicle for transporting players about a golf course.

U.S. Pat. No. 4,951,339, issued to Braun on Aug. 28, 1990, discloses a motor powered cleaning assembly for the washing of golf club heads including a housing having a power brush rotatably mounted thereon and a removable cleaning fluid containing tray disposed in substantially enclosing relation to the brush wherein the housing and the tray are cooperatively structured for the removable placement and manipulation of the club head therein into a plurality of engaging positions with the rotary brush so as to clean opposite sides thereof as well as the striking face on both left and right-handed clubs.

U.S. Pat. No. 4,944,063, issued to Jordan on Jul. 31, 1990, discloses an apparatus that can be attached to a golf cart or the like for washing the face of a golf club. The iron club is placed within an opening formed in the top of the golf club washer. With one hand holding the club steady, the other hand holds the upper part of a brush handle which protrudes out of the top of the golf club washer. The brush is moved with an up-and-down motion causing the brush to clean the face of the iron club. After several up-and-down motions, the cleaned club is removed from the golf club washer.

U.S. Pat. No. 4,872,232, issued to Stiasny on Oct. 10, 1989, discloses a portable golf club head cleaner includes a body having a location for receiving a golf club head and a reservoir for holding a liquid. A brush for cleaning the golf club head includes means for moveably mounting the brush within the body, adjacent the location. Pumping means pump liquid from the reservoir onto the brush on operation of manually operable means which simultaneously pumps the pumping means and moves the brush to clean a golf club head at the location. The brush may move in a reciprocal manner or may be cylindrical in shape and move by rotation about its axis. The pumping means can include a piston within the reservoir moveable between an upper and lower position and a shaft having an internal tube connecting the piston to the manually operable means. The manually operable means moves in a reciprocal manner to reciprocate the shaft and piston forcing liquid from the reservoir into the tube on downward stroke of the piston. The liquid travels up the tube and is expressed onto the brush. The brush may be attached to the shaft for reciprocal movement therewith.

U.S. Pat. No. 4,821,358, issued to Wyckoff et al. on Apr. 18, 1989, discloses a golf club head washing device, suitable for attachment to a golf cart or for mounting on posts at various locations on a golf course, includes a cylindrical housing for holding a cleaning fluid. The housing has guide rails located in it for supporting a pair of plastic brush blocks, with the brushes thereof facing one another across a diameter of the housing. A removable cover is releasably attached to the top of the housing; and the cover has an elongated slot in it, which is aligned with the space between the brush blocks. The brush blocks have tapered flanges on the opposing edges for engagement between guide rails on the inside of the housing to permit the blocks to be easily inserted and then wedged in place within the housing. When the brushes wear out, the blocks are removed by lifting them out of the housing. Then they are replaced with new blocks.

U.S. Pat. No. 4,734,953, issued to Dodson on Apr. 5, 1989, discloses a dual brush assembly specifically designed for cleaning both iron and wood type golf club heads. A small housing structure is provided and within that housing structure a pair of brushes is movably mounted. One brush is a relatively hard brush designed for brushing and cleaning the head of an iron type golf club. The other brush is a relatively soft brush and specifically designed for cleaning the head of a wood type golf club.

U.S. Pat. No. 4,541,138, issued to Dodson on Sep. 17, 1985, discloses a golf club head cleaning machine that uses two pairs of cylindrical brushes—one pair for the irons, the other for woods. The brushes of each pair operate in close proximity and the cleaning is done in the areas of proximity. In these areas the bristles of the brushes move in opposite directions in order to reduce the structural loads on the joints between the heads and clubs. The brushes for the woods are accessible through an opening in the lower front of the machine and operate dry. The brushes for the irons are wetted and are accessible through a curtained slot which lies essentially in a horizontal plane and extends across the front and part way back on each side of the machine. This slot allows the club heads to be moved through the passage from one side of the machine to the other and therefore allows for using a conveyor to move the clubs through the machine. The curtains in the opening and slot prevent escape of debris and the cleaning liquid. The brushes for the irons mounted one above the other, are parallel to each other and to the front of the machine and are in a plane which is at an angle to the essentially horizontal plane of the passage such that the upper brush is closer to the back of the machine. The preferred angle is approximately 60 degrees. The brushes for the woods are also parallel to each other and to the front of the machine and are in a plane which is about 10 degrees out of vertical with the upper brush farther from the back of the machine.

U.S. Pat. No. 4,472,581, issued to Dodson on Sep. 25, 1984, discloses a washing device for automatically brushing and applying cleaning fluid to a soiled implement such as a golf club. The device has a cylindrical rotating brush, cleaning nozzles for directing jets of cleaning fluid axially along the peripheral surface of the rotating brush, and hood means enclosing at least one end of the brush to capture the undeviated portion of the cleaning jet. Portions of the cleaning jet and brush are exposed while the device is in use, permitting the progress of cleaning to be determined without interruption. In a preferred mode of the invention the axis of rotation of the brush is vertical, the jets of water are directed vertically upward, and the brush is driven by a turbine powered by the same water supply that provides cleaning fluid. A self-draining basin formed integrally with the hood can be disposed about the cleaning area. The cleaning jets are preferably taken from the housing of the turbine, and are formed by nozzles comprising holes in the upper portion of the turbine housing.

U.S. Pat. No. 4,464,072, issued to Norwell on Aug. 7, 1984, discloses a cleaning device, particularly adapted for releasable attachment to a golf bag, to enable rapid and complete cleaning of golf clubs during play. The device preferably comprises a liquid container having a liquid spray means positioned therein; a retaining means which includes a sleeve for holding the container, a clip means for attaching to the top of the golf bag, and a support release; and a brush means. Lobes on the rear of the container engage the upper beaded edge of the wall of the golf bag preventing accidental displacement from the bag. Outwardly projecting portions on the sleeve conform to the rounded exterior of the bag and provide a fulcrum permitting the lobes to be pivoted away from the beaded edge by pressing against lower portion of the support release. By this arrangement, the whole device is securely fastened to the golf bag during normal play and club cleaning, and yet easy removal of the container and the associated brush and spray are permitted when required.

U.S. Pat. No. 4,384,384, issued to Trojohn on May 24, 1983, discloses an efficient, durable and inexpensive golf club cleaner that comprises a pair of superimposed and connected plate-like brush-supporting members wherein one plate-like member is provided with a large centrally disposed rectangular recess and the other, which is substantially smaller, is provided with a registering central opening which is defined by a frame-like recess in the smaller plate-like member which is adapted to overlie and secure the edges of the back of a rectangular brush that is disposed in the aforementioned recess with the bristles of the brush extending through and projecting from the aforementioned opening. Means are provided for securing the smaller plate-like member to the larger plate-like member when the former is in assembled position; and also means for firmly attaching the larger plate-like member to a suitable support.

U.S. Pat. No. 3,950,810, issued to Harkess on Apr. 20, 1976, discloses a golf club cleaning apparatus that is capable of cleaning both right-handed and left-handed irons and woods and is also capable of cleaning the faces and the bottom of irons as well as the front driving face and sole plate of woods. A first opening into the apparatus is provided for right-handed clubs, and a second opening is provided for left-handed clubs, with each opening being designed to accept either a wood or an iron for cleaning of the same. The overall appearance of the apparatus resembles a golf ball sitting on a tee, with the upper portion being at least partially filled with a cleaning or washing liquid. A golf club is held in place after insertion through one of the openings into the device, with the bottom and back in contact with a receiving tray. Cleaning of the club head is effected by rotating a semi-spherical brush connected with an externally extending crank, with the brush being at least partially immersed in the cleaning liquid and maintained to contact with the front face of the club by a spring bias on the receiving tray urging the club front face in a horizontal direction toward the brush. The inlet openings into the apparatus are angularly spaced from the top of the apparatus so that a club inserted therethrough will have predetermined positioning with respect to the brushes within the apparatus to enhance club cleaning In addition, a separate compartment is divided to accommodate foreign matter dislodged from club heads during cleaning, and this minimizes club damage during subsequent club cleaning operations.

None of the golf club cleaning devices known to those of ordinary skill in the art, however, provide the desired ease of manufacture; the multiple cleaning surfaces, the ability to be selectively disposed in the ground at a predetermined location associated with a golf course, practice range, or the like; the ease of use; the ability to be cleaned and/or partially replaced; the ability to provide advertising and/or information, etc. The golf club cleaning device of the present invention fulfills these needs, among others.

BRIEF SUMMARY OF THE INVENTION

In various exemplary embodiments, the present invention provides a golf club cleaning device, for cleaning the head of a golf club, that includes a cleaning portion comprising an upper cleaning surface and a lower cleaning surface; a flag portion disposed at the top end of the cleaning portion, the flag portion comprising a gripping means wherein the portable golf club cleaning device is gripped; and a spike portion disposed at a bottom end of the cleaning portion substantially opposite the top end of the cleaning portion, the spike portion comprising a support means for supporting the portable golf club cleaning device in an upright manner when depressed into the ground.

In one exemplary embodiment, the cleaning portion comprises a substantially-spherical shaped cleaning portion. In another exemplary embodiment, the cleaning portion comprises a substantially-cylindrical shaped cleaning portion. The upper cleaning surface and the lower cleaning surface may comprise a majority of a volume of the cleaning portion or, alternatively, the upper cleaning surface and the lower cleaning surface are disposed on a surface of the cleaning portion. Preferably, the upper cleaning surface and the lower cleaning surface consist of one or more natural bristles, synthetic bristles, natural fibers, synthetic fibers, matting materials, weaves, and/or fabrics.

The flag portion consists of one of a substantially-two-dimensional flag portion having an associated length dimension that is substantially greater than an associated width dimension and a substantially-three-dimensional flag portion having the associated length dimension that is substantially equal to the associated width dimension. The spike portion includes a tapering tip portion. In one exemplary embodiment, the flag portion includes a threaded portion that is configured to engage a corresponding threaded portion of the cleaning portion. Likewise, the spike portion includes a threaded portion that is configured to engage a corresponding threaded portion of the cleaning portion.

In another exemplary embodiment, the flag portion and the spike portion are integrally formed and include a shaft portion disposed therebetween, the shaft portion selectively disposed through a channel disposed along a vertical axis running through the cleaning portion from the first end of the cleaning portion to the second end of the cleaning portion. The shaft portion and the channel are each keyed such that, when the shaft portion is disposed through the channel, the shaft portion does not rotate with respect to the channel or, alternatively, the shaft portion and the channel are each shaped such that, when the shaft portion is disposed through the channel, the shaft portion does not rotate with respect to the channel. Optionally, the flag portion further includes a collar portion. Likewise, the spike portion further includes a collar portion. Preferably, the flag portion and the spike portion each consist of one of a metal, a hardened plastic, and a composite material. The flag portion includes a surface configured to receive one or more of an advertising logo and informational text thereon.

Optionally, the flag portion, the cleaning portion, and the spike portion, viewed as a whole, are selectively "golf tee" shaped. The "golf tee" shape is familiar to the golfer and accordingly provides ease of use when gripping the flag portion of the device and subsequently depressing the spike portion into the ground.

A method for manufacturing the golf club cleaning device, for cleaning the head of a golf club, is also provided. The method includes: providing a cleaning portion comprising an upper cleaning surface and a lower cleaning surface; providing a flag portion disposed at the top end of the cleaning portion, the flag portion comprising a gripping means wherein the portable golf club cleaning device is gripped; providing a spike portion disposed at a bottom end of the cleaning portion substantially opposite the top end of the cleaning portion, the spike portion comprising a support means for supporting the portable golf club cleaning device in an upright manner when depressed into the ground; securing the flag portion to the cleaning portion; and securing the spike portion to the cleaning portion. Optionally, the flag portion, cleaning portion, and spike portion are integrally formed.

By grasping the flag portion, the spike portion is selectively disposed in the ground at a predetermined location associated with a golf course, practice range, or the like, thereby allowing a player to clean his/her golf club by selectively running the front face and/or rear face of the golf club horizontally and/or vertically across the one or more cleaning surfaces/materials of the cleaning portion. Advantageously, the flag portion may incorporate an advertising logo and/or informational text.

In a further exemplary embodiment, the present invention provides a portable golf club cleaning device, for cleaning the head of a golf club, including: a cleaning portion comprising one or more cleaning surfaces disposed concentrically about a central axis; a flag portion disposed at the top end of the cleaning portion, the flag portion comprising a gripping means wherein the portable golf club cleaning device is gripped; and a spike portion disposed at a bottom end of the cleaning portion substantially opposite the top end of the cleaning portion, the spike portion comprising a support means for supporting the portable golf club cleaning device in an upright manner when depressed into the ground. Optionally, the one or more cleaning surfaces are disposed concentrically about a central bore defining an interior chamber that is selectively used as a fluid reservoir, the one or more cleaning surfaces in fluid communication with the fluid reservoir.

In a still further exemplary embodiment, the present invention provides a tool for installing a portable golf club cleaning device into the ground, including: a handle; a guide spike selectively coupled to the handle; and a hammer attached to the handle.

In a still further exemplary embodiment, the present invention provides a portable golf club cleaning device, for cleaning the head of a golf club, including: a cleaning portion with one or more outwardly-facing exterior cleaning surfaces disposed about a central axis; a handle portion disposed at a top end of the cleaning portion including a gripping member whereby the portable golf club cleaning device is selectively gripped; and an elongated spike portion disposed at a bottom end of the cleaning portion substantially opposite the top end of the cleaning portion, the elongated spike portion extending from the cleaning portion and wherein central axes of the handle portion and the spike portion are vertically aligned, the elongated spike portion providing a support means for supporting the portable golf club cleaning device in an upright manner when depressed into the ground. Optionally, the cleaning portion includes a substantially-conical shaped cleaning portion. Optionally, the cleaning portion includes a substantially-tapered cleaning portion. Optionally, the one or more outwardly-facing exterior cleaning surfaces include one or more arrangements of natural bristles, synthetic bristles, natural fibers, synthetic fibers, matting materials, weaves, fabric, and metal fibers. Optionally, the handle portion includes one of a substantially-two-dimensional gripping portion having an associated length dimension that is substantially greater than an associated width dimension and a substantially-three-dimensional gripping portion having the associated length dimension that is substantially equal to the associated width dimension. Preferably, the spike portion includes a tapering tip portion.

There has thus been outlined, rather broadly, the features of the present invention in order that the detailed description that follows may be better understood, and in order that the present contribution to the art may be better appreciated. There are additional features of the invention that will be described and which will form the subject matter of the claims. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Additional aspects and advantages of the present invention will be apparent from the following detailed description of an exemplary embodiment which is illustrated in the accompanying drawings.

BRIEF DESCRIPTION OF THE DRAWINGS

The present invention is illustrated and described herein with reference to the various drawings, in which like reference numbers denote like components/parts, and in which:

FIG. 8 is a cross-sectional side view (with accompanying cross-sectional end view) illustrating a further exemplary embodiment of the golf club cleaning device of the present invention, the golf club cleaning device incorporating concentrically-arranged alternating bristles or the like;

DETAILED DESCRIPTION OF THE INVENTION

Before describing the disclosed embodiments of the present invention in detail, it is to be understood that the invention is not limited in its application to the details of the particular arrangement shown since the invention is capable of other embodiments. Also, the terminology used herein is for the purpose of description and not of limitation.

Figure 1:
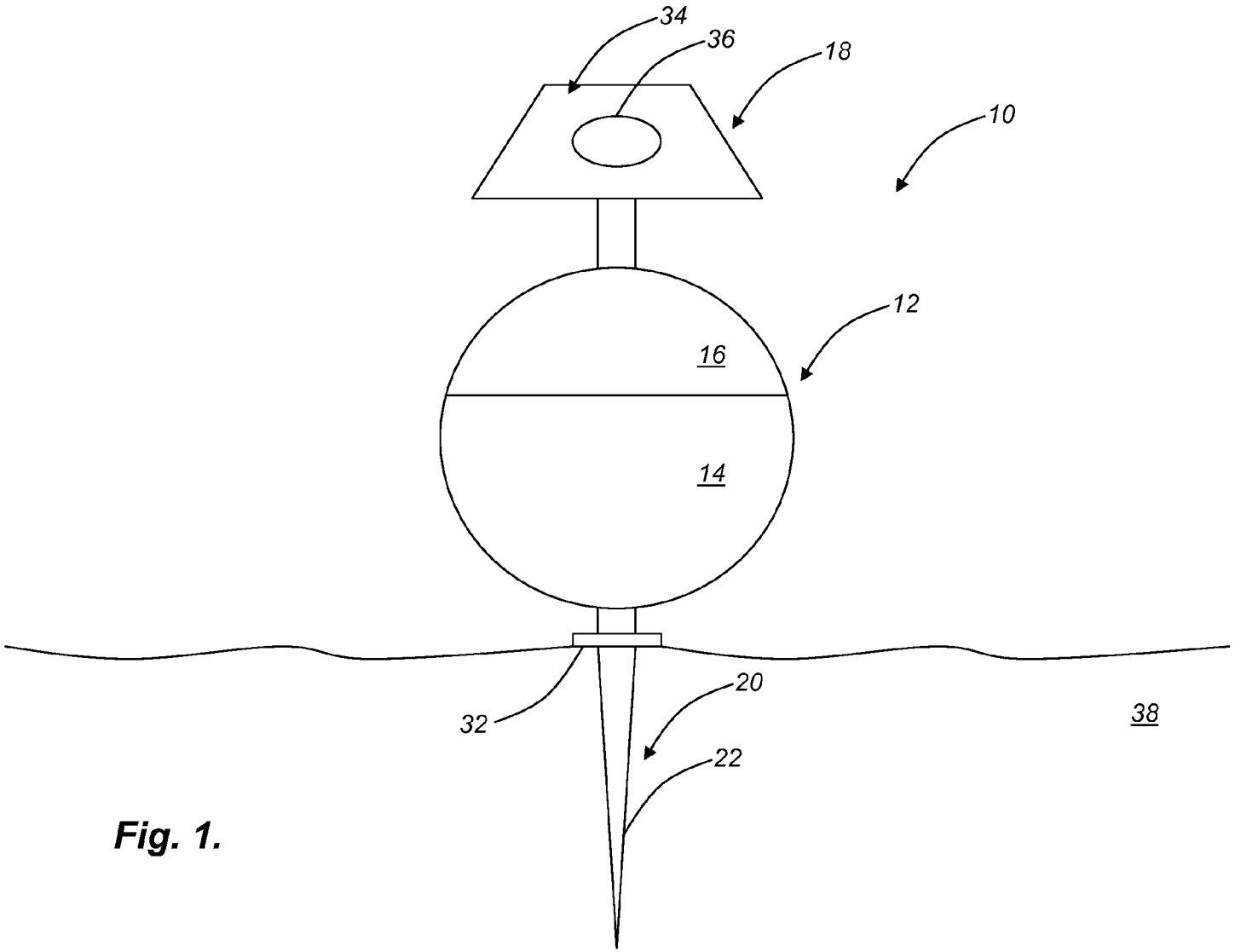
FIG. 1 is a planar side view illustrating one exemplary embodiment of the golf club cleaning device of the present invention, the golf club cleaning device including a substantially-spherical cleaning portion consisting of a plurality of cleaning surfaces/materials, among other features.
Figure 2:
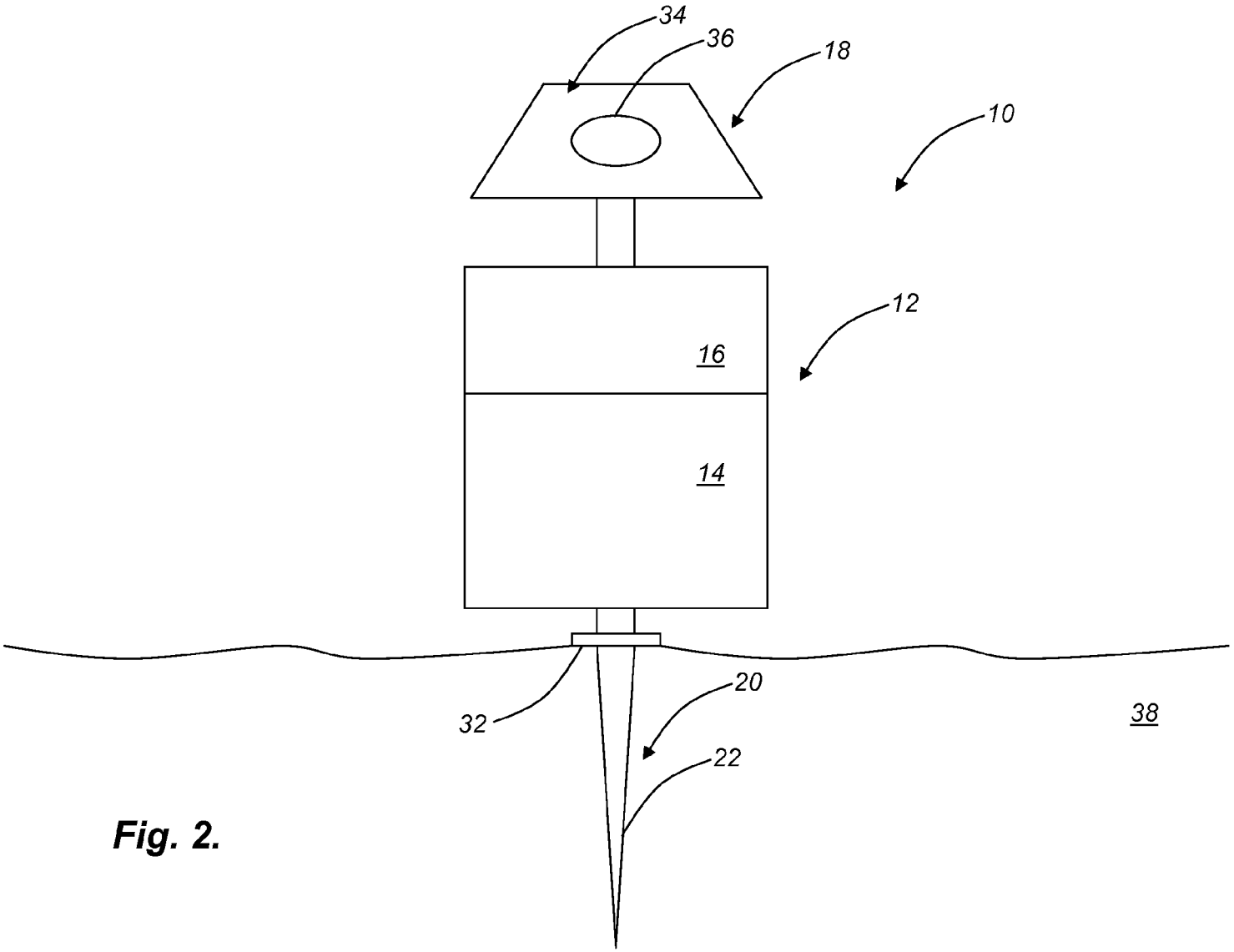
FIG. 2 is a planar side view illustrating another exemplary embodiment of the golf club cleaning device of the present invention, the golf club cleaning device including a substantially-cylindrical cleaning portion consisting of a plurality of cleaning surfaces/materials, among other features.
Figure 3:
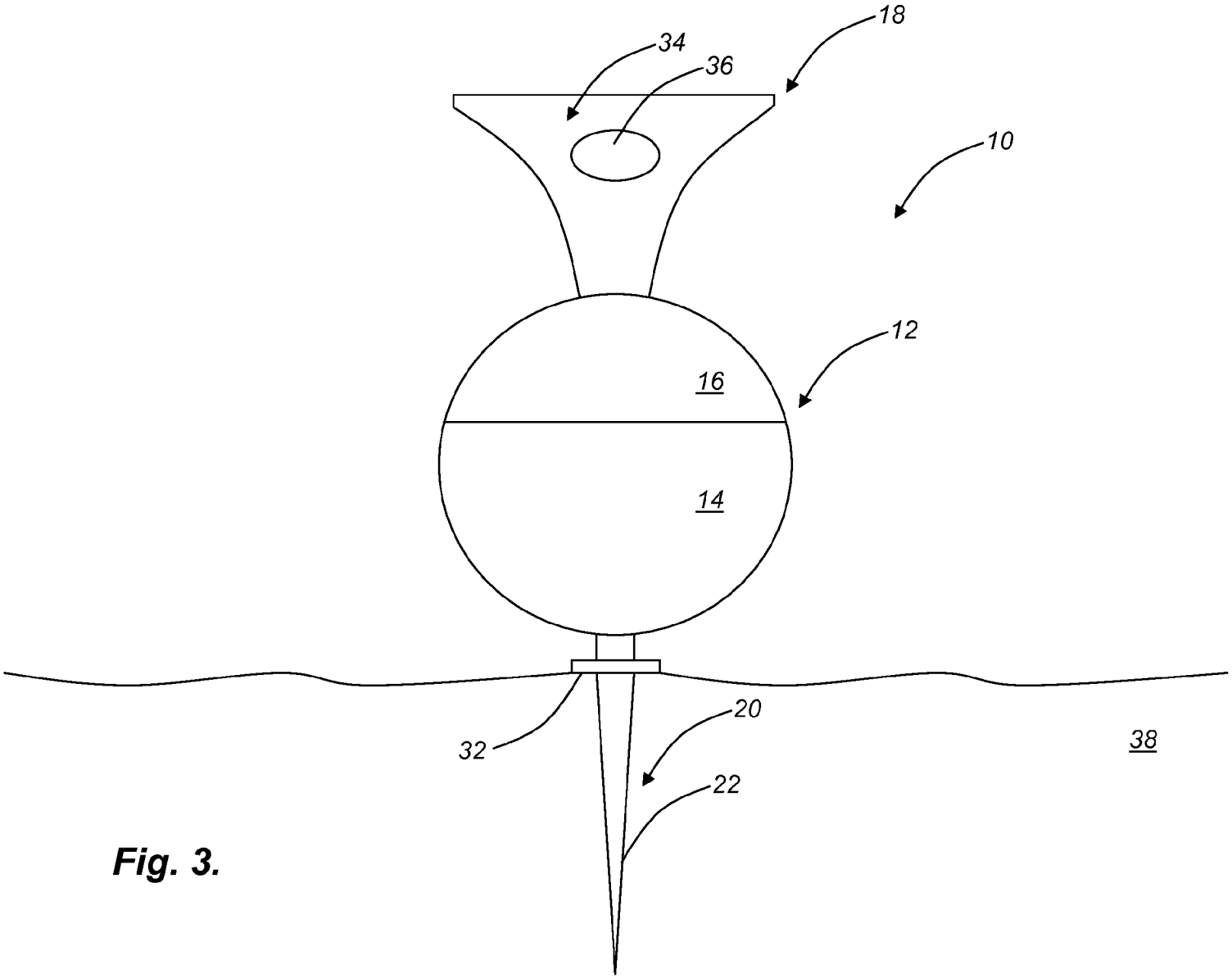
FIG. 3 is a planar side view illustrating a further exemplary embodiment of the golf club cleaning device of the present invention, the golf club cleaning device including a substantially-spherical cleaning portion consisting of a plurality of cleaning surfaces/materials, among other features.

Referring to FIGS. 1-3, in various exemplary embodiments, the present invention provides a golf club cleaning device 10 that includes a cleaning portion 12, including an upper cleaning surface 16; a lower cleaning surface 14; a flag portion 18 disposed at a first end of the cleaning portion 12; and a spike portion 20 disposed at a second end of the cleaning portion 12 substantially opposite the first end of the cleaning portion 12. In various alternative embodiments (see FIGS. 8 and 9), concentrically-arranged alternating cleaning surfaces may also be utilized, as opposed to upper and lower cleaning surfaces.

Referring to FIG. 1, in one exemplary embodiment, the cleaning portion 12 comprises a substantially-spherical shaped cleaning portion. The cleaning portion 12 has a diameter on the order of several inches, although other suitable dimensions may be utilized. Referring to FIG. 2, in another exemplary embodiment, the cleaning portion 12 comprises a substantially-cylindrical shaped cleaning portion. Again, the cleaning portion 12 has a diameter and/or height on the order of several inches, although other suitable dimensions may be utilized. It should be noted that, although a substantially-spherical shaped cleaning portion is illustrated in FIG. 1 and a substantially-cylindrical shaped cleaning portion is illustrated in FIG. 2, the cleaning portion 12 may utilize any suitable shape, as is illustrated in FIG. 3, for example. Other suitable shapes that may be utilized include conical, partial conical, curved-conical, partial curved-conical, etc.

The upper cleaning surface 16 and the lower cleaning surface 14, or concentrically-arranged cleaning surfaces (FIGS. 8 and 9), whether including contiguous or discrete cleaning surface elements or areas, may comprise a majority of a volume of the cleaning portion 12 or, alternatively, the cleaning surfaces 14, 16 are disposed on a surface of the cleaning portion 12. These two alternatives are illustrated in FIGS. 4-6, which illustrate upper cleaning surface 16 and the lower cleaning surface 14 comprising a majority of a volume of the cleaning portion 12, and FIG. 7, which illustrates the upper cleaning surface 16 and the lower cleaning surface 14 being disposed on a surface of the cleaning portion 12.

Preferably, the upper cleaning surface 16 and the lower cleaning surface 14, or concentrically-arranged cleaning surfaces (FIGS. 8 and 9), whether including contiguous or discrete cleaning surface elements or areas, consist of one or more natural bristles, synthetic bristles, natural fibers, synthetic fibers, matting materials, weaves, fabrics, and/or metal fibers. However, other suitable materials may be utilized. It should be noted that, although FIGS. 1-7 illustrate the upper cleaning surface 16 and the lower cleaning surface 14 (with, for example, natural bristles being used on the bottom 14 and fabric used on the top 16), one or multiple materials may be used, and the cleaning portion may have more than two cleaning surfaces.

The flag portion 18, or handle portion, consists of one of a substantially-two-dimensional flag portion having an associated length/width dimension that is substantially greater than an associated width/length dimension and a substantially-three-dimensional flag portion (cap portion) having the associated length dimension that is substantially equal to the associated width dimension. The flag portion 18 has a length, width, and/or diameter on the order of a fraction of an inch to several inches, although other suitable dimensions may be utilized. Alternatively, the flag portion 18 may include a simple handle and/or gripping members extending from the central axis of the golf club cleaning device 10. Preferably, the spike portion 20 includes a tapering tip portion 22. The spike portion 20 has a length, width, and/or diameter on the order of a fraction of an inch to several inches, although other suitable dimensions may be utilized. Each tapering tip portion 22 may include multiple anti-rotation fins, ridges, or other structures. Optionally, the spike portion 20 includes multiple tapering tip portions 22.

Figure 4:
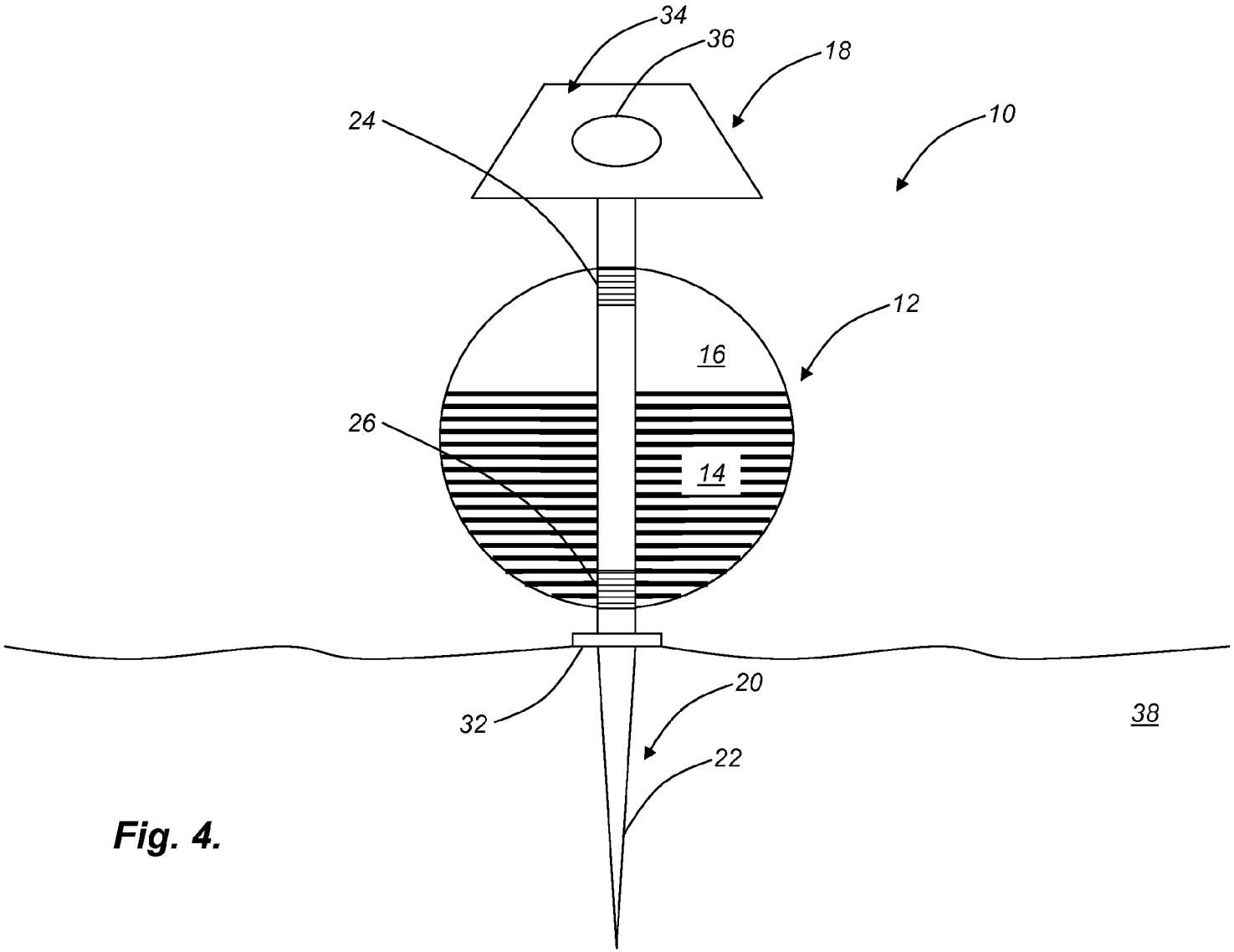
FIG. 4 is a cross-sectional side view illustrating one exemplary embodiment of the golf club cleaning device of FIG. 1, the golf club cleaning device incorporating a threaded flag portion and spike portion, among other features.
Figure 5:
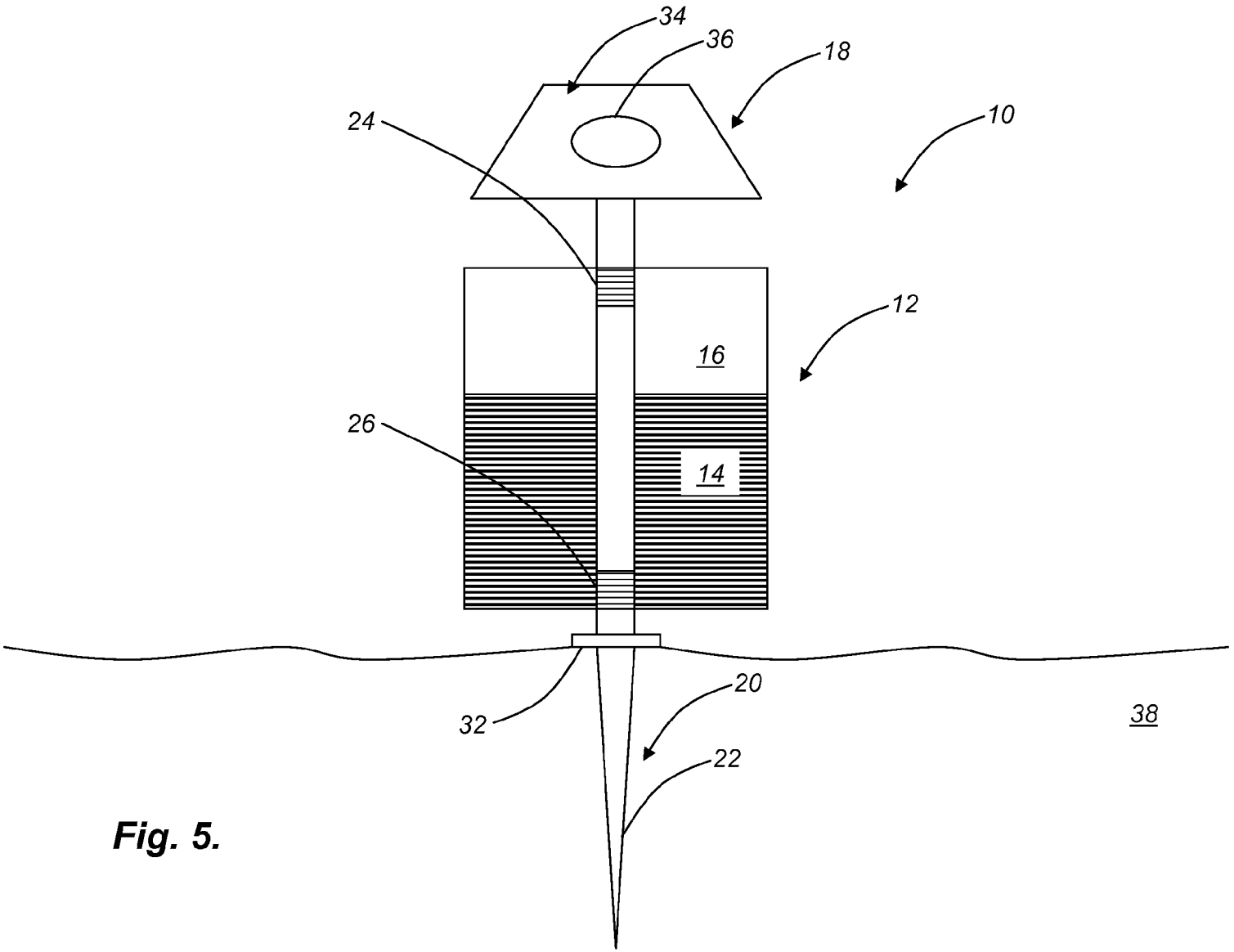
FIG. 5 is a cross-sectional side view illustrating one exemplary embodiment of the golf club cleaning device of FIG. 2, the golf club cleaning device incorporating a threaded flag portion and spike portion, among other features.
Figure 6:
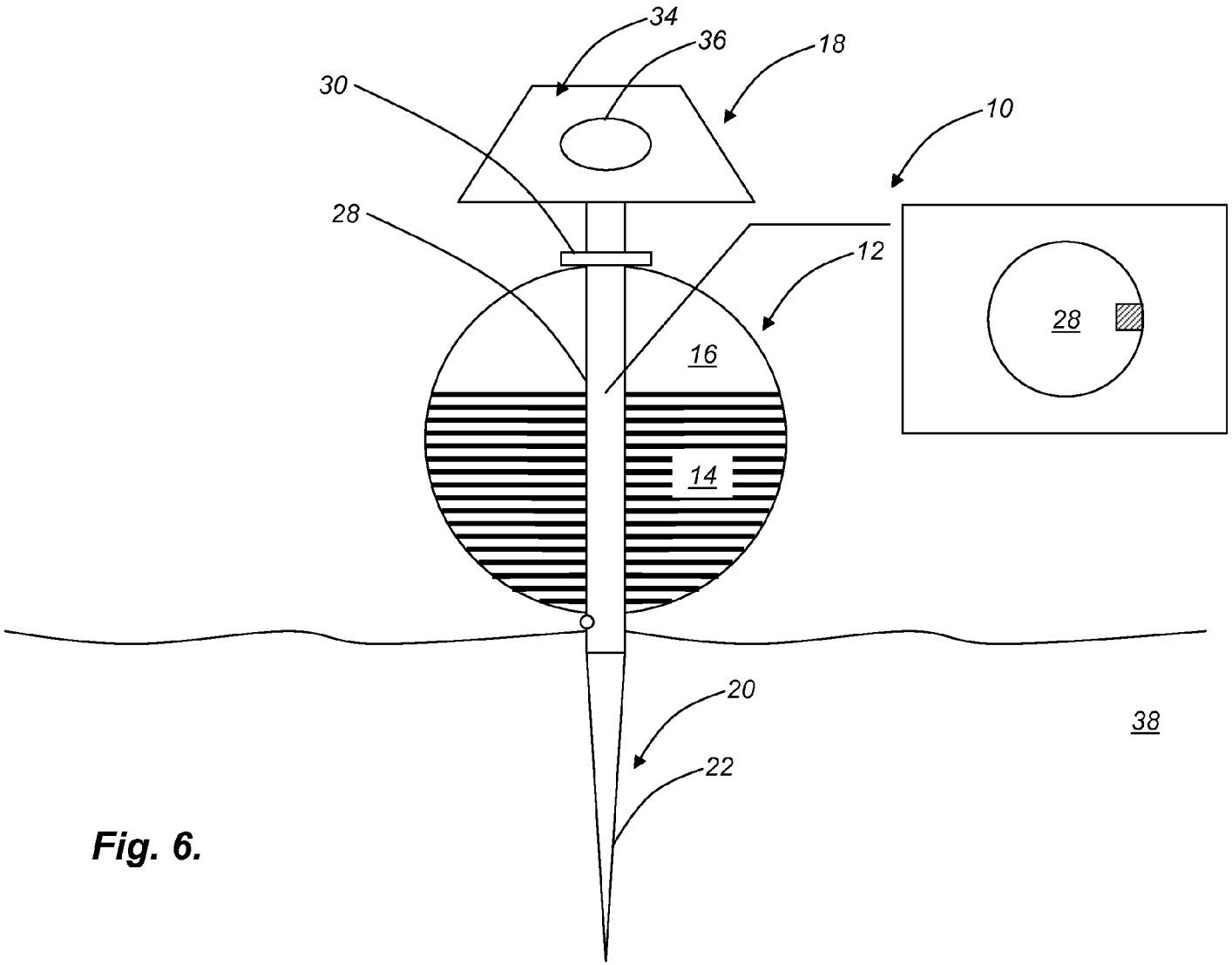
FIG. 6 is a cross-sectional side view illustrating another exemplary embodiment of the golf club cleaning device of FIG. 1, the golf club cleaning device incorporating an integrally-formed flag portion and spike portion, among other features.

Referring to FIGS. 4 and 5, in one exemplary embodiment, the flag portion 18 includes a threaded portion 24 that is configured to engage a corresponding threaded portion of the cleaning portion 12. Likewise, the spike portion 20 includes a threaded portion 26 that is configured to engage a corresponding threaded portion of the cleaning portion 12.

Figure 7:
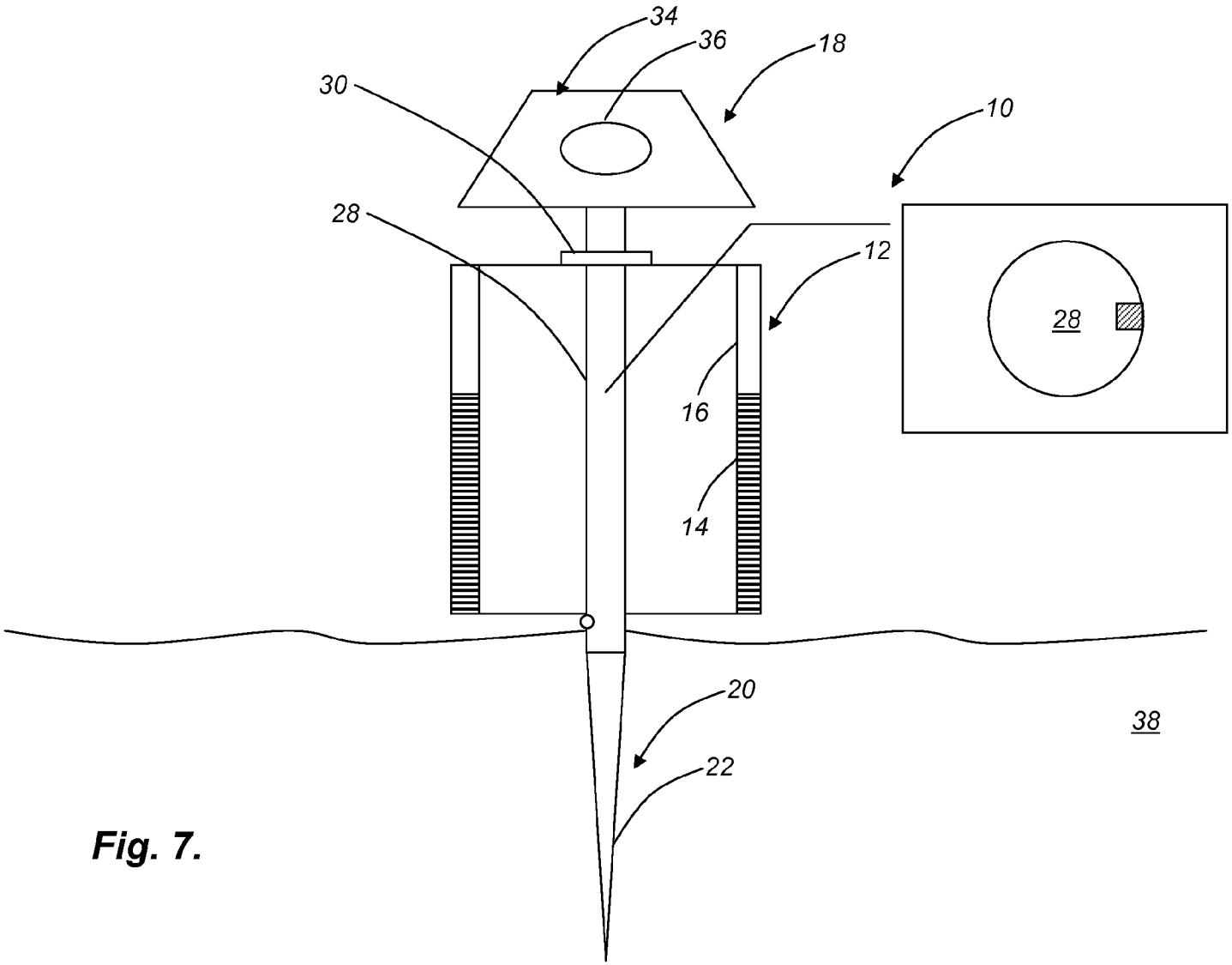
FIG. 7 is a cross-sectional side view illustrating another exemplary embodiment of the golf club cleaning device of FIG. 2, the golf club cleaning device incorporating an integrally-formed flag portion and spike portion, wherein the substantially-cylindrical cleaning portion is substantially hollow, among other features.

Referring to FIGS. 6 and 7, in another exemplary embodiment, the flag portion 18 and the spike portion 20 are integrally formed and include a shaft portion 28 disposed therebetween, the shaft portion 28 selectively disposed through a channel disposed along a vertical axis running through the cleaning portion 12 from the first end of the cleaning portion 12 to the second end of the cleaning portion 12. The shaft portion 28 and the channel are each keyed such that, when the shaft portion 28 is disposed through the channel, the shaft portion 28 does not rotate with respect to the channel or, alternatively, the shaft portion 28 and the channel are each shaped (octagonal, square, triangular, etc.) such that, when the shaft portion 28 is disposed through the channel, the shaft portion 28 does not rotate with respect to the channel. Other suitable anti-rotational mechanisms may also be utilized.

Optionally, the flag portion 18 (FIGS. 6 and 7) further includes a collar portion 30. Likewise, the spike portion 20 (FIGS. 1-5) further includes a collar portion 32. Preferably, the flag portion 18 and the spike portion 20 each consist of one of a metal, a hardened plastic, and a composite material, although other suitable materials may be utilized. The flag portion 18 includes a surface 34 configured to receive one or more of an advertising logo and informational text 36 thereon.

Optionally, the flag portion 18 and the spike portion 20 are selectively "golf tee" shaped. This is illustrated in FIG. 3. The "golf tee" shape is familiar to the golfer and accordingly provides ease of use.

A method for manufacturing the golf club cleaning device is also contemplated herein. The method includes: providing a cleaning portion comprising an upper cleaning surface and a lower cleaning surface; providing a flag portion disposed at the top end of the cleaning portion, the flag portion comprising a gripping means wherein the portable golf club cleaning device is gripped; providing a spike portion disposed at a bottom end of the cleaning portion substantially opposite the top end of the cleaning portion, the spike portion comprising a support means for supporting the portable golf club cleaning device in an upright manner when depressed into the ground; securing the flag portion to the cleaning portion; and securing the spike portion to the cleaning portion. Optionally, the flag portion, cleaning portion, and spike portion are integrally formed.

By grasping the handle portion 18, the spike portion 20 is selectively disposed in the ground 38 at a predetermined location associated with a golf course, practice range, or the like, thereby allowing a player to clean his/her golf club by selectively running the front face and/or rear face of the golf club horizontally and/or vertically across the upper cleaning surface 16 and the lower cleaning surface 14 of the cleaning portion 12. Advantageously, the flag portion 18 may incorporate an advertising logo and/or informational text 36.

Figure 8:
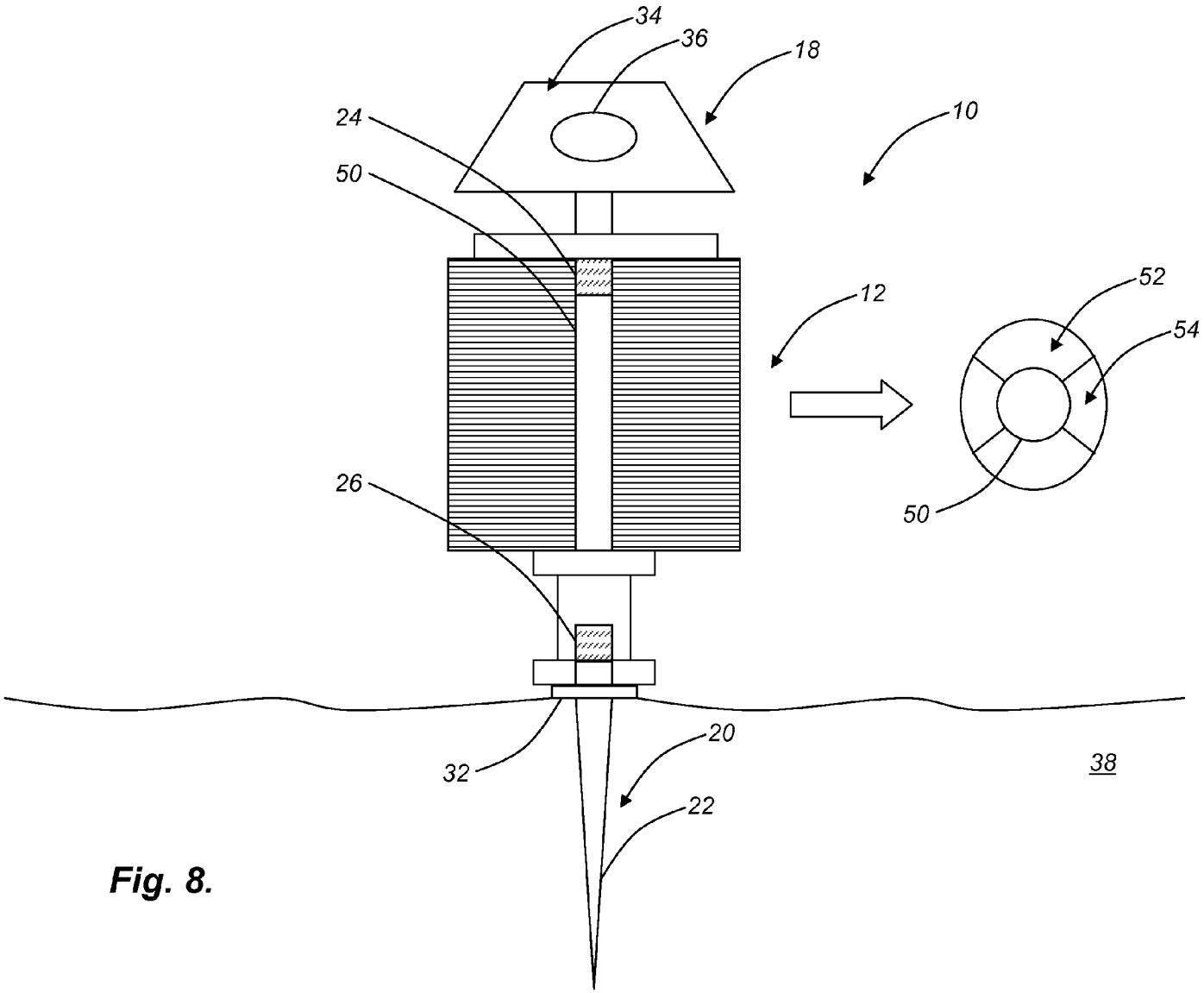

Referring to FIG. 8, in a further exemplary embodiment of the present invention, the cleaning portion 12 includes a central bore 50 around which one or more concentrically-arranged cleaning materials, such as one or more types of bristles (having predetermined thicknesses, stiffnesses, softnesses, textures, colors, etc.), are disposed. In the embodiment illustrated, two alternating types of bristles 52 and 54 are provided.

Figure 9:
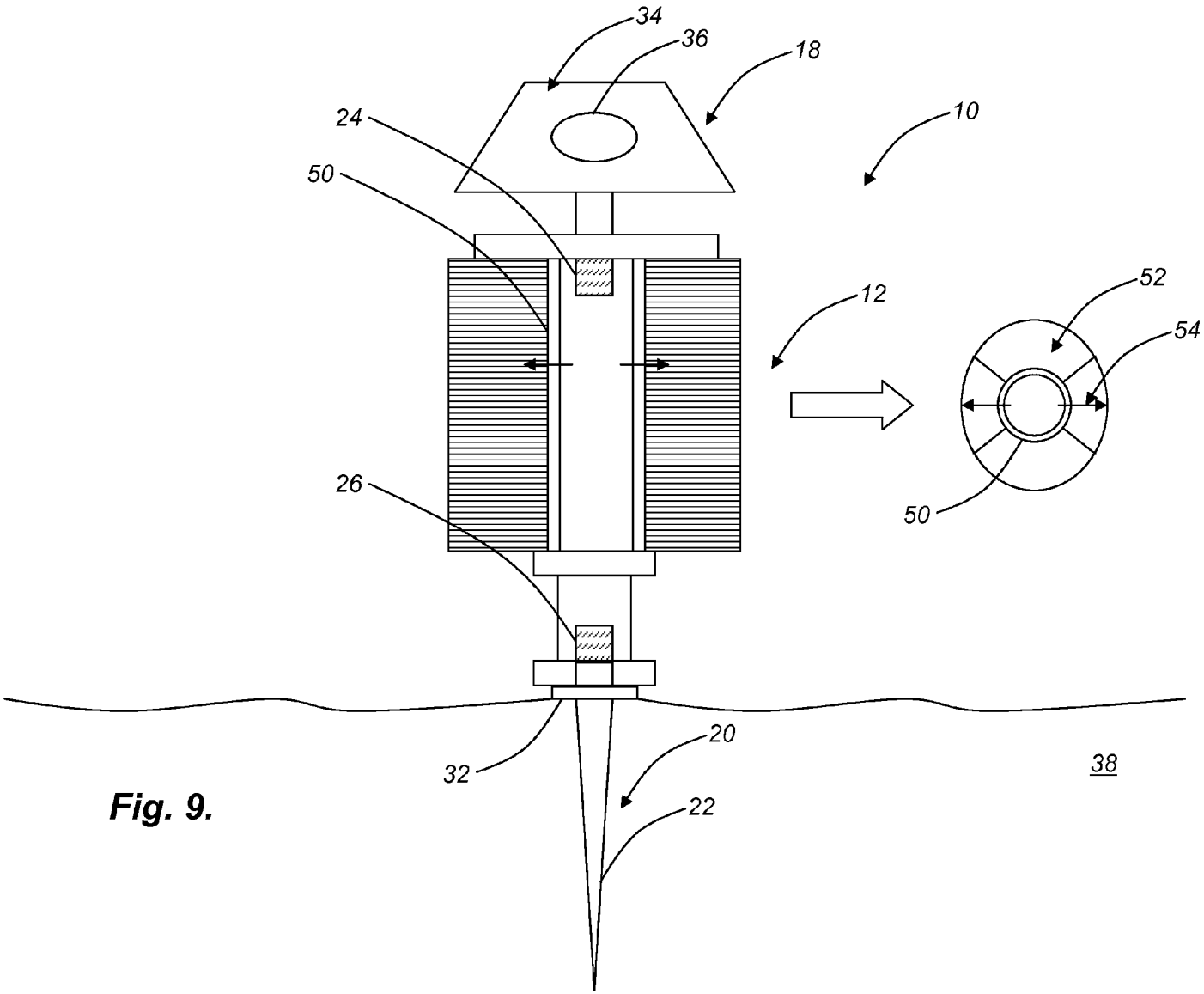
FIG. 9 is a cross-sectional side view (with accompanying cross-sectional end view) illustrating a still further exemplary embodiment of the golf club cleaning device of the present invention, the golf club cleaning device incorporating concentrically-arranged alternating bristles or the like and a fluid dispensation system.

Referring to FIG. 9, in a still further exemplary embodiment of the present invention, the cleaning portion 12 again includes a central bore 50 around which one or more concentrically-arranged cleaning materials, such as one or more types of bristles (having predetermined thicknesses, stiffnesses, softnesses, textures, colors, etc.), are disposed. In the embodiment illustrated, two alternating types of bristles 52 and 54 are provided. In this embodiment, however, the central bore 50 includes a plurality of holes therethrough. When the central bore 50 is filled with water or another cleaning fluid, for example, this cleaning fluid is allowed to gradually seep into the cleaning elements, which consist of clusters or bristles, for example, and thereby wet the golf club or the like being cleaning. In this sense, the central bore 50 serves as a cleaning fluid reservoir.

Figure 10:
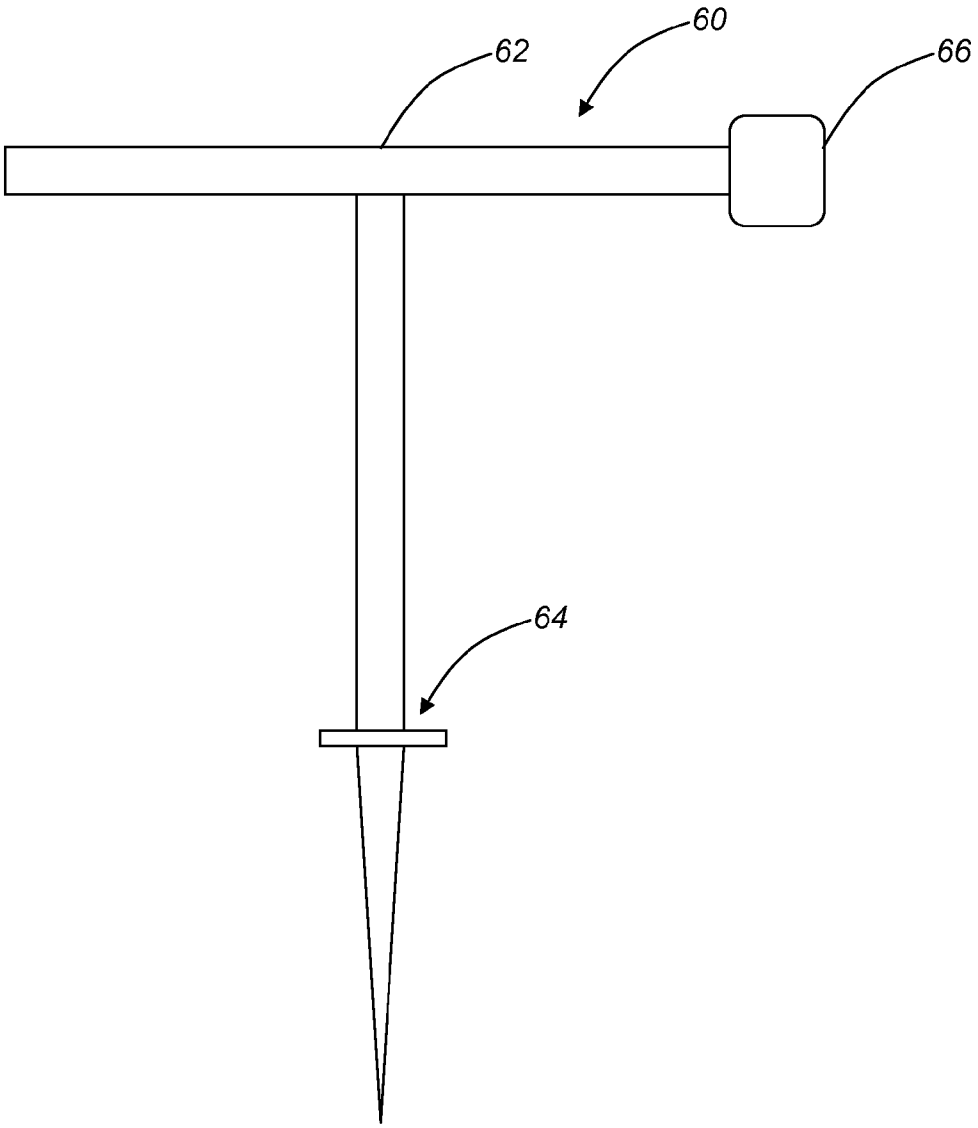
FIG. 10 is a planar side view illustrating an exemplary embodiment of a tool for installing the golf club cleaning device of the present invention.

Referring to FIG. 10, in one exemplary embodiment, a tool 60 for installing the golf club cleaning device 10 (FIGS. 1-9) of the present invention includes a handle 62 that it selectively coupled to a guide spike 64. This guide spike 64 is driven into the ground using the handle 62. Subsequently, the guide spike 64 is removed from the ground such that the golf club cleaning device 10 may be placed. Alternatively, the guide spike 64 may serve as the actual spike portion 20 (FIGS. 1-9) of the golf club cleaning device 10. If necessary, the guide spike 64 is driven into the ground using a hammer 66 attached to the handle 62. This hammer is replaceable.

Although the present invention is illustrated and described herein with reference to preferred embodiments and specific examples thereof, it will be readily apparent to one of ordinary skill in the art that other embodiments and examples may perform similar functions and/or achieve like results. For example, the cleaning device of the present invention may clearly be used for cleaning other than golf clubs, etc. All such equivalent embodiments and examples are within the spirit and scope of the present invention, are contemplated thereby, and are intended to be covered by the following claims.

What is claimed is:

1. A portable golf club cleaning device, for cleaning the head of a golf club, comprising:

a cleaning portion with one or more outwardly-facing exterior cleaning surfaces disposed about a central axis;

a handle portion disposed at a top end of the cleaning portion comprising a gripping member whereby the portable golf club cleaning device is selectively gripped; and an elongated spike portion disposed at a bottom end of the cleaning portion substantially opposite the top end of the cleaning portion, the elongated spike portion extending from the cleaning portion and wherein central axes of the handle portion and the spike portion are separated from one another but vertically aligned, the elongated spike portion comprising a support means for supporting the portable golf club cleaning device in an upright manner when depressed into the ground.

2. The portable golf club cleaning device of claim 1, wherein the cleaning portion comprises a substantially-conical shaped cleaning portion.

3. The portable golf club cleaning device of claim 1, wherein the cleaning portion comprises a substantially-tapered cleaning portion.

4. The portable golf club cleaning device of claim 1, wherein the one or more outwardly-facing exterior cleaning surfaces comprise one or more arrangements of natural bristles, synthetic bristles, natural fibers, synthetic fibers, matting materials, weaves, fabric, and metal fibers.

5. The portable golf club cleaning device of claim 1, wherein the one or more cleaning surfaces comprise a majority of the volume of the cleaning portion.

6. The portable golf club cleaning device of claim 1, wherein the handle portion comprises one of a substantially-two-dimensional gripping portion having an associated length dimension that is substantially greater than an associated width dimension and a substantially-three-dimensional gripping portion having the associated length dimension that is substantially equal to the associated width dimension.

7. The portable golf club cleaning device of claim 1, wherein the spike portion comprises a tapering tip portion.

8. The portable golf club cleaning device of claim 1, wherein the handle portion comprises a threaded portion that is configured to engage a corresponding threaded portion of the cleaning portion.

9. The portable golf club cleaning device of claim 1, wherein the spike portion comprises a threaded portion that is configured to engage a corresponding threaded portion of the cleaning portion.

10. The portable golf club cleaning device of claim 1, the handle portion further comprising a collar portion.

11. The portable golf club cleaning device of claim 1, the spike portion further comprising a collar portion.

* * * * *